United States Patent [19]

Leigh et al.

[11] Patent Number: 4,892,555

[45] Date of Patent: Jan. 9, 1990

[54] METHOD FOR CONDITIONING FABRICS

[75] Inventors: Arthur G. Leigh, Wirral; John Oakes, Cheshire, both of England

[73] Assignee: Lever Brothers Company, New York, N.Y.

[21] Appl. No.: 243,165

[22] Filed: Sep. 8, 1988

Related U.S. Application Data

[63] Continuation of Ser. No. 82,023, Aug. 5, 1987, abandoned.

[30] Foreign Application Priority Data

Aug. 6, 1986 [GB] United Kingdom ..... 8619152

[51] Int. Cl.[4] ..... D06L 3/00

[52] U.S. Cl. ..... 8/101; 8/111; 8/137; 252/8.8; 427/242

[58] Field of Search ..... 8/137, 111; 427/242; 252/8.8

[56] References Cited

U.S. PATENT DOCUMENTS

| | | | |
|---|---|---|---|
| 3,156,654 | 11/1964 | Konecny et al. | 252/95 |
| 3,332,882 | 7/1967 | Blumbergs et al. | 252/186 |
| 3,442,692 | 5/1969 | Gaiser | 117/120 |
| 4,085,243 | 4/1978 | Giordano et al. | 427/387 |
| 4,128,494 | 12/1978 | Schirmann et al. | 252/186 |
| 4,421,657 | 12/1983 | Allen et al. | 252/8.6 |
| 4,460,487 | 7/1984 | Robinson et al. | 252/8.8 |
| 4,578,200 | 3/1986 | Burkett St. Laurent et al. | 252/8.8 |

FOREIGN PATENT DOCUMENTS

| | | |
|---|---|---|
| 844481 | 6/1970 | Canada . |
| 122141 | 10/1984 | European Pat. Off. . |
| 82563 | 6/1985 | European Pat. Off. . |
| 204484 | 10/1986 | European Pat. Off. . |
| 69-021238 | 6/1964 | Japan . |
| 44-21238 | 9/1969 | Japan . |
| 686344 | 9/1968 | South Africa . |
| 907356 | 10/1959 | United Kingdom . |
| 836988 | 9/1960 | United Kingdom . |
| 855735 | 12/1960 | United Kingdom . |
| 907358 | 10/1962 | United Kingdom . |
| 970950 | 5/1963 | United Kingdom . |
| 1003310 | 9/1965 | United Kingdom . |
| 1246339 | 9/1971 | United Kingdom . |
| 1454504 | 11/1976 | United Kingdom . |
| 1550206 | 8/1979 | United Kingdom . |
| 2122657 | 5/1982 | United Kingdom . |
| 2132655 | 7/1984 | United Kingdom . |
| 2132656 | 7/1984 | United Kingdom . |
| 2150951 | 6/1985 | United Kingdom . |
| 2149316 | 7/1985 | United Kingdom . |
| 2150952 | 10/1985 | United Kingdom . |
| 2157729 | 10/1985 | United Kingdom . |
| 2257730 | 10/1985 | United Kingdom . |

*Primary Examiner*—Paul Lieberman
*Assistant Examiner*—John F. McNally
*Attorney, Agent, or Firm*—Milton L. Honig

[57] ABSTRACT

A method for conditioning fabrics comprises tumble-drying fabrics with a composition comprising a fabric conditioner, such as a cationic fabric softener, and a compound containing a transition metal ion, such as cobalt (II) and manganese (II) ions. The transition metal ion is capable of catalyzing bleaching of the fabrics when the fabrics are subsequently washed with a bleach containing detergent composition.

7 Claims, No Drawings

METHOD FOR CONDITIONING FABRICS

This is a continuation application of Ser. No. 082,023, filed Aug. 5, 1987, now abandoned.

The present invention relates to a method of conditioning fabrics. In particular, it relates to a method of conditioning fabrics comprising tumbling damp fabrics under the action of heat in a laundry dryer with a conditioning composition.

On completion of a washing process damp fabrics can be tumble dried in a laundry dryer. It is known from U.S. Pat. No. 3,442,692 (Gaiser) to condition damp fabrics in a laundry dryer by tumbling them together with a flexible substrate carrying a conditioning agent, whereby the agent is transferred to the fabric.

It is also known, from for example GB 2132655 and GB 2132656 (Unilever), to form built detergent bleach compositions comprising a surface active agent, a peroxide compound and a heavy metal compound which comprises a transition metal ion, such as manganese.

In achieving the bleach catalysis disclosed in the above mentioned patents the transition metal ion is present in the bleach containing detergent composition. However, while catalytic bleaching is conveniently obtained under such conditions the efficiency of the process may be comparatively low dur to complexation of the transition metal ion by components of the detergent composition and wasteful bleach decomposition in solution. It may, therefore, be desirable to seek a more efficient may of utilising the catalytic power of the transition metal ion without using washing compositions which contain the transition metal compounds. The present invention seeks to overcome this problem.

We have now discovered that conditioning, and catalysed bleaching in the subsequent wash can be achieved if fabrics are tumble dried with a conditioning composition comprising a fabric conditioner and a compound containing a transition metal ion.

Thus, according to the invention there is provided a method of conditioning fabrics which comprises tumbling damp fabrics in a laundry dryer with a composition comprising a fabric conditioner and a compound containing a transition metal ion, selected from groups 4b--7b, 8, and 1b of the Periodic Table.

It is surprising that the catalytic activity of the metal ion is not reduced by the usual components of conditioning compositions and that it is not affected by ageing or changes which occur during the tumble drying process. Furthermore, it is surprising that the metal ion is capable of catalysing bleaching of treated fabrics when the fabrics are subsequently washed in a bleach containing detergent composition.

A method according to the invention comprises contacting the fabrics with a composition which preferably contains 0.025–1.25% of the transition metal ion. More specifically, we have found beneficial results for compositions containing cobalt ions, when the level of metal ions is from 0.025–0.25%, and for manganese, when the level of metal ion is from 0.025–1.25%. Under typical operating conditions this corresponds to a level of transition ion metal on the cloth in the subsequent wash within the range from 1 to 50 parts per million (ppm).

A conditioning composition used in the method according to the invention is preferably in the form of a free flowing powder disposed within a dispersing device. In one form of dispensing device disclosed in GB 2 122 657 (Unilever), the free flowing powder composition is disposed within an inner container, which comprises a sachet of flexible material permeable to said composition. This sachet is disposed within an outer container having openings for the egress of said composition in the powder form. An alternative dispensing device is disclosed in a copending British patent application 85 13480 (Unilever) in which the powder is releasably disposed within a stacking cup container. The particle size of the powder is preferably in the range from 90 to 250 μm.

The fabric conditioner used in the invention includes either a fabric softening agent or an antistatic agent or a mixture of such agents. Any well known cationic or nonionic fabric softening agent or antistatic agent can be used in the present invention, as well as mixtures of two or more such agents.

Highly preferred cationic materials are quaternary ammonium salts having the formula:

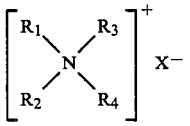

The cationic softening agents useful herein are quaternary ammonium salts wherein $R_1$ and $R_2$ represent hydrocarbyl groups having from about 12 to about 24 carbon atoms; $R_3$ and $R_4$ represent hydrocarbyl groups containing from 1 to about 4 carbon atoms; and X is an anion, preferably selected from halide, methyl sulfate and ethyl sulfate radicals. Representative examples of these quaternary softeners include ditallow dimethyl ammonium chloride; ditallow dimethyl ammonium methyl sulfate; dihexadecyl dimethyl ammonium chloride, di(hydrogenated tallow alkyl) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; di(coconut alkyl) dimethyl ammonium chloride. Ditallow dimethyl ammonium chloride, di(hydrogenated tallow alkyl) dimethyl ammonium chloride, di(coconut alkyl) dimethyl ammonium chloride and di(coconut alkyl) dimethyl ammonium methosulfate are preferred.

The antistatic agents useful herein are quaternary ammonium salts wherein at least one, but not more than two, of $R_1$, $R_2$, $R_3$ and $R_4$ is an organic radical containing a group selected from a $C_{16}$–$C_{22}$ aliphatic radical, or an alkyl phenyl or alkyl benzyl radical having 10–16 atoms in the alkyl chain, the remaining group or groups being selected from hydrocarbyl groups containing from 1 to about 4 carbon atoms, or $C_2$–$C_4$ hydroxy alkyl groups and cyclic structures in which the nitrogen atom forms part of the ring, and Y is an anion such as halide, methylsulfate, or ethylsulfate.

Representative examples of quaternary ammoninium antistatic agents include dicetyl dimethyl ammonium chloride; bis-docosyl dimethyl ammonium chloride; didodecyl dimethyl ammonium chloride; ditallow dimethyl ammonium bromide; ditallow dimethyl ammonium chloride; ditallow dipropyl ammonium bromide; ditallow dibutyl ammonium fluoride; cetyldecylmethylethyl ammonium chloride; bis-[ditallow dimethyl ammonium]sulfate; and tris-[ditallow dimethyl ammonium]phosphate. Dioctadecyldimethyl ammonium chloride and ditallow dimethyl ammonium chloride are preferred.

Another class of preferred cationic materials are the alkylimidazolinium salts believed to have the formula:

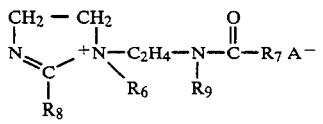

The cationic softening agents useful herein are imidazolinium compounds wherein $R_6$ is an alkyl or hydroxyalkyl group containing from 1 to 4, preferably 1 or 2 carbon atoms, $R_7$ is an alkyl or alkenyl group containing from 8 to 25 carbon atoms, $R_8$ is an alkyl or alkenyl group containing from 8 to 25 carbon atoms, and $R_9$ is hydrogen or an alkyl group containing from 1 to 4 carbon atoms and $A^-$ is an anion, preferably a halide, methosulfate or ethosulfate. Preferred imidazolinium salts include 1-methyl-1-(tallowylamido-)ethyl-2-tallowyl-4,5-dihydro imidazolinium methosulfate and 1-methyl-1-(palmitoylamido)ethyl-2-octadecyl-4,5-dihydroimidazolinium chloride. Other useful imidazolinium materials are 2-heptadecyl-1-methyl-1-(2-stearylamido)ethyl-imidazolinium chloride and 2-lauryl-1-hydroxyethyl-1-oleyl-imidazolinium chloride. Also suitable herein are the imidazolinium fabric softening components of U.S. Pat. No. 4 127 489, incorporated by reference.

Suitable imidazolinium antistatic compounds include methyl-1-alkylamidoethyl-2-alkyl imidazolinium methyl sulfates, specifically 1-methyl-1-[(tallowamido)ethyl]-2-tallowimidazolinium methyl sulfate.

Typical nonionic fabric softening agents include the fatty acid esters of mono- or polyhydric alcohols, or anhydrides thereof, containing from 1 to 8 carbon atoms such as sorbitan esters including sorbitan monostearate, and sorbitan tristearate, ethylene glycol esters including ethylene glycol monostearate, glycerol esters including glycerol monostearate, alkyl mono or di-alkanolamides such as palm or tallow mono ethanolamide and tallow di-ethanolamide, and other such materials disclosed in GB 1 550 206, the disclosure of which is incorporated herein by reference.

Alternative nonionic fabric softening agents include lanolin and lanolin-like materials such as acetylated lanolin.

Suitable nonionic antistatic agents include $C_6$–$C_{22}$ aliphatic alcohol ethoxylates having from 5 to 30 EO i.e. 5 to 30 units of ethylene oxide per molecule.

It is an essential feature of the present invention that the conditioning composition for use according to the present invention further comprises a transition metal containing compound. The transition metal is selected from groups 4b–7b, 8 and 1b of the Periodic Table (CRC Handbood of Chemistry and Physics, 57th Edition). The transition metal ion is preferably selected from the group comprising manganese, cobalt and copper. Any conventional counter ion is acceptable. Preferably the counter ion should not sequester the metal ion nor should it be susceptible to oxidation. The counter ion is more preferably chloride or nitrate, most preferably sulphate.

The conditioning composition may also contain one or more optional ingredients selected from perfumes, perfume carriers, fluorescers, colourants, antiredeposition agents, enzymes, optical brightening agents, opacifiers, anti-shrinking agents, anti-wrinkle agents, fabric crisping agents, spotting agents, soil-release agents, germicides, fungicides, anti-oxidants, anti-corrosion agents, preservatives, dyes and drape imparting agents A method according to the invention comprises tumbling damp fabrics in a laundry dryer with the conditioning composition. The fabrics are subsequently washed with a bleach containing detergent composition.

The bleach containing detergent composition usually comprises a peroxybleach compound in an amount from about 4% to about 50% by weight, preferably from about 10% to about 35% by weight. Typical examples of suitable peroxybleach compounds are alkali metal perborates, both tetrahydrates and monohydrates, alkali metal percarbonates and persilicates.

The composition may also contain activators for peroxybleach compounds. These compounds have been amply described in the literature, including British patents 836 988, 855 735, 907 356, 907 358, 970 950, 1 003 310 and 1 246 339; U.S. Pat. Nos. 3 332 882 and 4 128 494; Canadian patent 844 481 and South African patent 68/6 344. Specific suitable activators include tetraacetyl glycoluril and tetraacetyl ethylene diamine.

The detergent composition further usually comprises a synthetic detergent active material otherwise referred to herein simply as a detergent compound. The detergent compounds may be selected from anionic, nonionic, zwitterionic and amphoteric synthetic detergent active materials. Many suitable detergent compounds are commercially available and are fully described in the literature, for example in "Surface Active Agents and Detergents", Volumes I and II, by Schwartz, Perry and Berch.

The preferred detergent compounds which can be used are synthetic anionic and nonionic compounds. The former are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolysing with a base to produce a random sulphonate; and olefin sulphonates, which term is used to describe the material made by reacting olefins, particularly $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

Suitable nonionic detergent compounds which may be used include in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, generally up to 25 EO, ie up to 25 units of ethylene oxide per molecule, the condensation products of aliphatic ($C_8$–$C_{18}$) primary or secondary linear or branched alcohols with ethylene oxide, generally up to 40 EO, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

Mixtures of detergent compounds, for example mixed anionic or mixed anionic and nonionic compounds may be used in the detergent compositions, particularly in the latter case to provide controlled low sudsing properties. This is beneficial for compositions intended for use in suds-intolerant automatic washing machines.

Amounts of amphoteric or zwitterionic detergent compounds can also be used in the compositions of the invention but this is not normally desired due to their relatively high cost. If any amphoteric or zwitterionic detergent compounds are used it is generally in small amounts in compositions based on the much more commonly used synthetic anionic and/or nonionic detergent compounds.

The detergent composition also usually contain from about 5% to about 90% of detergency builder. Suitable detergency builder salts can be of the polyvalent inorganic or polyvalent organic types, or mixtures thereof. Examples of suitable inorganic builders include alkali metal borates, carbonates, silicates, ortho-phosphates, and polyphosphates. Examples of suitable organic builders include alkylsuccinates, nitrilotriacetates, alkylmalonates and citrates.

A further class of builder salt is the insoluble aluminosilicate type.

Other components/adjuncts commonly used in detergent compositions are for example soil-suspending or antideposition agents such as the water-soluble salts of carboxymethylcellulose carboxyhydroxymethylcellulose, copolymers of maleic anhydride and vinyl ethers, and polyethylene glycols having a molecular weight of about 400 to 10,000. These can be used at levels of about 0.5% to about 10% by weight. Dyes, pigments, optical brighteners, perfumes, anti-caking agents, suds control agents and fillers can also be added in varying amounts as desired.

The invention is further illustrated by the following non-limiting Examples.

EXAMPLES 1–8

1.5 kg batches of terry towelling and 3 pieces of "bleach sensitive" test cloth, each measuring 23×23 cm, were washed together with a bleach free, sodium tripolyphosphate built detergent composition and then spun under typical UK conditions. Each batch was then dried in a Creda Debonair tumble dryer set on its low heat setting; the duration of the drying cycle was 1 hour. During the drying cycle each batch was treated with the treatment composition disposed within a dispensing device.

The conditioning compositions used in the following examples were prepared as follows. Arosurf TA 100, which is a commercially available powdered form of distearyl dimethyl ammonium chloride, was mixed with distilled water and heated to form a paste. A solution containing the appropriate amount of metal salt was added to this paste with mixing. After blending and drying the composition was milled to a powder form. The powder was finally sieved and the 90–180 μm fraction collected.

The dispensing device used in the examples consisted of an inner sachet, placed within an outer container in the form of a hollow vented polypropylene sphere of diameter 9.5 cm constructed in two parts with a snap-fit mechanism. The sachet was formed from non-woven fabric (Storalene) laminated on the inside with a heat sealable powder impermeable polyethylene film and had six 2 mm dispensing holes, as described in GB 2 149 825 (Unilever). A tear strip prevented the egress of the composition from the sachet until the required time.

Each sachet contained 6 grams of Arosurf or of an Arosurf/metal salt mixture with a particle size range within the range of 90 to 180 μm. The metal salt was a compound selected from the group comprising copper sulphate, manganese sulphate, and cobalt sulphate and was present in an amount ranging from 0–1.25% of the metal ion, expressed on the total weight of the conditioning composition.

At the end of the drying cycle the treated test cloths were cut into squares measuring 5 cm×5 cm and four were washed in a liter of solution containing 5 grams of a bleach containing detergent composition. The total duration of the wash cycle was 30 minutes and the final termperature reached was 40° C.

After washing and subsequent drying, the percentage reflectance of the test cloths at 460 nm was measured using a Zeiss "Elrepho" reflectometer fitted with a UV filter and the reflectance change, ΔR 460*, was determined by comparing the measured reflectance of treated test cloth with that of the untreated cloth.

EXAMPLES 1–2

The treated cloths were washed with a detergent composition comprising 9.3% surfactant, 30.2% sodium tripolyphosphate, 5.7% sodium silicate, 20.5% sodium sulphate, 20% sodium percarbonate and minor amounts of other cnventional detergent additives.

The bleaching effects were as follows:

Example 1

| % by weight $Co^{2+}$ | ppm $Co^{2+}$ deposited on the cloth | ΔR 460* |
|---|---|---|
| 0 | 0 | 1.4 |
| 0.025 | 1 | 2.9 |
| 0.0625 | 2.5 | 5.6 |
| 0.125 | 5.0 | 6.7 |
| 0.250 | 10 | 7.0 |

Example 2

| % by weight $Mn^{2+}$ | ppm $Mn^{2+}$ deposited on the cloth | ΔR 460* |
|---|---|---|
| 0 | 0 | 1.4 |
| 0.25 | 10 | 1.8 |

-continued

| % by weight $Mn^{2+}$ | ppm $Mn^{2+}$ deposited on the cloth | ΔR 460* |
|---|---|---|
| 0.50 | 20 | 3.0 |
| 0.75 | 30 | 3.8 |
| 1.25 | 50 | 3.4 |

Examples 3–4

The cloths were washed with a detergent composition comprising 9.9% surfactant, 32.1% sodium tripolyphosphate, 6% sodium silicate, 21.7% sodium sulphate, 12.5% sodium perborate, 2.3% tetraacetyl ethylene diamine and minor amounts of other conventional detergent additives.

The bleaching effects were as follows:

Example 3

| % by weight $Co^{2+}$ | ppm $Co^{2+}$ deposited on the cloth | ΔR 460* |
|---|---|---|
| 0 | 0 | 2.4 |
| 0.025 | 1.0 | 3.5 |
| 0.0625 | 2.5 | 3.8 |
| 0.125 | 5.0 | 5.0 |
| 0.250 | 10 | 6.2 |

Example 4

| % by weight $Mn^{2+}$ | ppm $Mn^{2+}$ deposited on the cloth | ΔR 460* |
|---|---|---|
| 0 | 0 | 2.4 |
| 0.25 | 10 | 3.0 |
| 0.50 | 20 | 3.8 |
| 0.75 | 30 | 3.2 |
| 1.25 | 50 | 3.4 |

EXAMPLES 5–6

The cloths were washed with a detergent composition comprising 6.9% nonionic surfactant, 8.5% sodium silicate, 26.4% sodium carbonate, 33.6% sodium sulphate, 20% sodium percarbonate and minor amounts of other conventional detergent additives.

The bleaching effects were as follows:

Example 5

| % by weight $Co^{2+}$ | ppm $Co^{2+}$ deposited on the cloth | ΔR 460* |
|---|---|---|
| 0 | 0 | 7.3 |
| 0.025 | 1 | 10.3 |
| 0.0625 | 2.5 | 15.8 |
| 0.125 | 5.0 | 17.1 |
| 0.250 | 10 | 19.0 |

Example 6

| % by weight $Mn^{2+}$ | ppm $Mn^{2+}$ deposited on the cloth | ΔR 460* |
|---|---|---|
| 0 | 0 | 7.3 |
| 0.25 | 10 | 9.2 |
| 0.50 | 20 | 10.7 |
| 0.75 | 30 | 12.9 |
| 1.25 | 50 | 13.9 |

EXAMPLES 7–8

The cloths were washed with a detergent composition comprising 7.3% nonionic surfactant, 9.0% sodium silicate, 28.1% sodium carbonate, 35.7% sodium sulphate, 12.5% sodium perborate, 2.3% tetraacetyl ethylene diamine and minor amounts of other conventional detergent additives.

The bleaching effects were as follows:

Example 7

| % by weight $Co^{2+}$ | ppm $Co^{2+}$ deposited on the cloth | R 460* |
|---|---|---|
| 0 | 0 | 5.1 |
| 0.025 | 1 | 6.0 |
| 0.0625 | 2.5 | 10.8 |
| 0.125 | 5.0 | 13.4 |
| 0.250 | 10 | 15.6 |

Example 8

| % by weight $Mn^{2+}$ | ppm $Mn^{2+}$ deposited on the cloth | R 460* |
|---|---|---|
| 0 | 0 | 5.1 |
| 0.25 | 10 | 6.5 |
| 0.50 | 20 | 7.5 |
| 0.75 | 30 | 10.0 |
| 1.25 | 50 | 10.2 |

From the above data it is clear that an improvement in bleaching is obtained then transition metal ions, in particular Cobalt II ions, have been deposited on the cloth during the tumble drying process and before subsequent washing of the cloth.

EXAMPLES 9–12

1.5 kg batches of terry towelling and 3 pieces of 'bleach sensitive' test cloth each measuring 23×23 cms were washed together with a bleach-free sodium tripolyphosphate built detergent composition to which had been added the appropriate amount of metal salt. Each batch was then dried in a Creda Debonair tumble dryer set on the low heat setting, the duration of the drying cycle being 1 hour. During the drying cycle each batch was treated with 6 g Arosurf TA100 powder, particle size range 90–180 μm, in a dispensing device. The dispensing device used was of the type previously described (Examples 1–8). At the end of the drying cycle the test cloths were cut into squares measuring 5×5 cm and washed in 1 liter of solution containing detergent composition and bleach at 40° C. Bleaching was again expressed in terms of R 460*, were R 460* is the difference in reflectance between the treated and untreated test cloths.

Examples 9–12 repeat Examples 1, 3, 5 and 7 except that the transition metal ion is deposited onto the test cloths during the wash process rather than during the tumble-dryer process.

Example 9

The treated cloths were washed with a detergent composition comprising 9.3% surfactant, 30.2% sodium tripolyphosphate, 5.7% sodium silicate, 20.5% sodium sulphate, 20% sodium percarbonate and minor amounts of other conventional detergent additives. Bleaching effects were as follows:

| Max ppm $Co^{2+}$ on the cloth | ΔR 460* | |
|---|---|---|
| | $Co^{2+}$ added in the wash | $Co^{2+}$ added in the tumble-dryer (Ex. 1) |
| 0 | 1.4 | 1.4 |
| 1 | 2.0 | 2.9 |
| 2.5 | — | 5.6 |
| 5.0 | 2.4 | 6.7 |
| 10.0 | 1.9 | 7.0 |

Example 10

The treated cloths were washed with a detergent composition comprising 9.9% surfactant, 32.1% sodium tripolyphosphate, 6% sodium silicate, 21.7% sodium sulphate, 12.5% sodium perborate, 2.3% tetra acetyl ethylene diamine and minor amounts of other conventional detergent additives. Bleaching effects were as follows:

| Max ppm $Co^{2+}$ on the cloth | ΔR 460* | |
|---|---|---|
| | $Co^{2+}$ added in the wash | $Co^{2+}$ added in the tumble-dryer (Ex. 3) |
| 0 | 2.4 | 2.4 |
| 1 | 2.6 | 3.5 |
| 2.5 | — | 3.8 |
| 5.0 | 3.6 | 5.0 |
| 10.0 | 2.3 | 6.2 |

Example 11

The treated cloths were washed with a detergent composition comprising 6.9% nonionic surfactant, 8.5% sodium silicate 26.4% sodium carbonate, 33.6% sodium sulphate, 20% sodium percarbonate and minor amounts of other conventional detergent additives. Bleaching effects are as follows:

| Max ppm $Co^{2+}$on the cloth | ΔR 460* | |
|---|---|---|
| | $Co^{2+}$ added in the wash | $Co^{2+}$ added in the tumble-dryer (Ex. 5) |
| 0 | 7.3 | 7.3 |
| 1 | 7.2 | 10.3 |
| 2.5 | — | 15.8 |
| 5.0 | 7.4 | 17.1 |
| 10.0 | 9.4 | 19.0 |

Example 12

The treated cloths were washed with a detergent composition comprising 7.3% nonionic surfactant, 9.0% sodium silicate, 28.1% sodium carbonate, 35.7% sodium sulphate, 12.5% sodium perborate, 2.3% sodium tetra acetyl ethylene diamina and minor amounts of other conventional detergent additives. Bleaching effects were as follows:

| Max ppm $Co^{2+}$ on the cloth | ΔR 460* | |
|---|---|---|
| | $Co^{2+}$ added in the wash | $Co^{2+}$ added in the tumble-dryer (Ex. 7) |
| 0 | 5.1 | 5.1 |
| 1 | 5.5 | 6.0 |
| 2.5 | — | 10.8 |
| 5.0 | 5.6 | 13.4 |
| 10.0 | 6.6 | 15.6 |

The results demonstrate that substantially larger catalytic effects are obtained on dryer-treated cloths than on wash-treated cloths. This reflects more efficient utilisation of $Co^{2+}$ in the dryer than in the wash.

We claim:

1. A method of conditioning and bleaching fabrics which comprises tumbling damp fabrics in a laundry dryer with a composition comprising a fabric conditioner which is a cationic material and a compound containing a transition metal ion, selected from groups 4b–7b, 8 and 1b of the Periodic Table, said composition added to the dryer separate from said fabrics, and subsequently washing said fabrics with a bleach containing composition.

2. A method according to claim 1 wherein the composition comprises the transition metal ion in an amount from 0.01 to 2.5%.

3. A method according to claim 1, wherein the transition metal ion is selected from the group consisting of manganese and cobalt ions.

4. A method according to claim 1, wherein the composition is in the form of a free-flowing powder.

5. A method according to claim 4, wherein the composition is disposed within a powder dispensing device.

6. A method according to claim 1, wherein said bleach composition is a peroxy bleach compound.

7. A method according to claim 6, wherein said peroxy bleach compound is selected from the group consisting of alkali metal perborates, both tetrahydrates and monohydrates, alkali metal percarbonates and persilicates.

* * * * *